US008959958B2

(12) United States Patent
Eppler

(10) Patent No.: US 8,959,958 B2
(45) Date of Patent: Feb. 24, 2015

(54) KNITTING MACHINE

(75) Inventor: Johannes-Martin Eppler, Balingen (DE)

(73) Assignee: SIPRA Patententwicklungs—und Beteiligungsgesellschaft mbH, Albstadt (DE)

( * ) Notice: Subject to any disclaimer, the term of this patent is extended or adjusted under 35 U.S.C. 154(b) by 0 days.

(21) Appl. No.: 13/882,787

(22) PCT Filed: Oct. 17, 2011

(86) PCT No.: PCT/EP2011/068101

§ 371 (c)(1),
(2), (4) Date: Jun. 4, 2013

(87) PCT Pub. No.: WO2012/059317

PCT Pub. Date: May 10, 2012

(65) Prior Publication Data

US 2013/0239624 A1 Sep. 19, 2013

(30) Foreign Application Priority Data

Nov. 3, 2010 (DE) ..... 10 2010 050 402

(51) Int. Cl.
*D04B 15/32* (2006.01)
*D04B 15/68* (2006.01)

(52) U.S. Cl.
CPC ..... *D04B 15/322* (2013.01); *D04B 15/32* (2013.01); *D04B 15/68* (2013.01)
USPC ..... 66/57; 66/78

(58) Field of Classification Search
CPC .... D04B 15/32; D04B 15/322; D04B 15/325; D04B 15/327; D04B 15/36
USPC ..... 66/78, 57
See application file for complete search history.

(56) References Cited

U.S. PATENT DOCUMENTS

| | | | | |
|---|---|---|---|---|
| 1,952,928 | A | 3/1934 | Lawson | |
| 2,067,733 | A * | 1/1937 | Robaczynski | 66/63 |
| 2,090,500 | A | 8/1937 | Lawson | |
| 2,617,282 | A | 11/1952 | Reichert | |
| 3,673,818 | A * | 7/1972 | Havranek et al. | 66/57 |
| 3,751,943 | A * | 8/1973 | Schindele | 66/216 |
| 3,934,431 | A | 1/1976 | Westmoreland, Sr. | |
| 4,018,063 | A | 4/1977 | Buck | |
| 4,037,434 | A * | 7/1977 | Durville et al. | 66/57 |
| 4,137,728 | A | 2/1979 | Durville | |

(Continued)

FOREIGN PATENT DOCUMENTS

| | | |
|---|---|---|
| CN | 1319691 | 10/2001 |
| DE | 1 265 910 | 4/1968 |

(Continued)

OTHER PUBLICATIONS

Knitting/Long Hairu, Editor—Beijing, China textile and Apparel Press, Jun. 30, 2008: Knitting; II Long: "Basic and modified weaves in Weft Knitting and Circular Knitting . . ." published by China textile and Apparel Press, Beijing, China.

*Primary Examiner* — Danny Worrell
(74) *Attorney, Agent, or Firm* — Michael J. Striker

(57) ABSTRACT

A knitting machine having needles which are mounted to be longitudinally moveable and having needle cams (14) with a needle control curve (13) for moving the needles, the needle control curves (13), at least in the latch closure region (Z), having a withdrawal angle (α)≤35°.

14 Claims, 4 Drawing Sheets

(56) References Cited

U.S. PATENT DOCUMENTS

Figure 1:
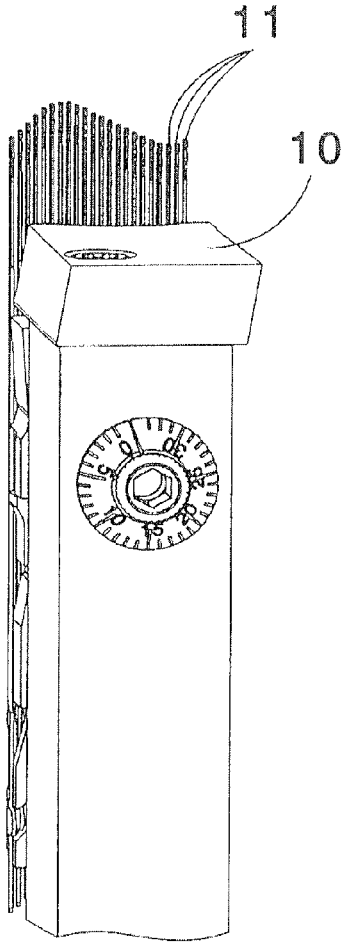

| | | | | |
|---|---|---|---|---|
| 4,592,215 | A | 6/1986 | Beck | |
| 4,693,092 | A | 9/1987 | Plath | |
| 5,243,839 | A * | 9/1993 | DiGiuseppe et al. | 66/108 R |
| 6,401,495 | B2 | 6/2002 | Eppler et al. | |

FOREIGN PATENT DOCUMENTS

| | | |
|---|---|---|
| DE | 72 42 789 | 11/1972 |
| DE | 24 08 924 | 8/1975 |
| DE | 34 33 290 | 3/1986 |

* cited by examiner

KNITTING MACHINE

CROSS-REFERENCE TO A RELATED APPLICATION

The invention described and claimed hereinbelow is also described in German patent Application 10 2010 050 402.5 filed on Nov. 3, 2010. This German Patent Application, whose subject matter is incorporated here by reference, provide the basis for a claim of priority of invention under 35 U.S.C. 119 (a)-(d).

The invention relates to a knitting or hosiery machine having latch needles which are mounted to be longitudinally moveable and having needle cams with a needle control curve for moving the needles.

Such knitting machines are known for example from DE 24 08 924 A1 and DE 34 33 290 A1. These machines are equipped in addition with sinkers which are moveable relative to the needles so that the path required for the loop-forming of a loop is covered partially by the needle forming the loop and partially by the sinker assigned to this needle. As a result, the needle control curves can have a flatter course than the needle control curves in machines in which the loop-forming depth is determined solely by the needle movement.

In the case of these known machines with latch needles, the needle control curves have however great steepness in the withdrawal region of the needles in which also closure of the latches is effected, i.e. the withdrawal speed of the needles is very high. As a result, also the closure process of the latch triggered by the thread is however also effected very rapidly, as a result of which the occurrence of wear to the latch bearing and also the latch slot can arise. In addition, the latch tip strikes the needle hook at great speed, which can lead to damage to the latch- and hook tip. The occurrence of wear in the latch slot and in the latch bearing lead to the latch no longer closing the needle hook perfectly. The latch frequently strikes to the side of the hook tip, which leads to the further appearance of wear to the hook tip and/or the latch spoon. If the hook tip and the latch tip are damaged, opening of the latch during knitting is however no longer ensured after thread breakage. The use of natural yarns accelerates wear even more.

In the case of the machine according to DE 34 33 290 A1, the needle control curve is provided, at the end of the withdrawal region, in fact with a horizontally extending portion, however the latch closure movement already begins in the steep portion situated in front. The horizontal portion in this needle control curve must be compensated for by a large gradient of the steeper portion in order that the required loop-forming depth can be achieved nevertheless over the available length of the needle control curve. The described occurrence of wear to the latch needles also therefore occurs here.

In addition, the needles which engage with a needle foot in the control curve of the needle cam experience acceleration and braking processes due to the portions of different gradients, which greatly stresses the needle feet guided in the control curves.

The object underlying the present invention is to propose a knitting or hosiery machine in which the needles are subjected to lower stresses, in particular when closing the latch, in order to increase the lifespan of the needles and/or the possible knitting speeds and/or system densities.

The object is achieved according to the invention by a knitting or hosiery machine of the initially mentioned type by the needle control curves, at least in the latch closure region of the withdrawal region, preferably in the entire withdrawal region for the needles, having a withdrawal angle ≤35°.

With these needle control curves, the needles are withdrawn at a relatively low speed, at least during closure of the latch, as a result of which the closure of the latch is effected also more slowly and hence more gently for the latch bearing, the latch slot and also the for the tips of the latch and of the needle hook than with known machines.

The needles are thereby treated in a particularly gentle mariner if the withdrawal angle of the needle control curves, at least in the needle closure region, is ≤30°.

If this flat course extends over the entire withdrawal region of the needles, then the needles are guided slowly into the loop-forming, as a result of which a thread-protecting loop formation is possible. The expulsion movement of the needle can in contrast be effected in a very steep manner so that altogether narrow constructional widths for the needle cams are achievable.

Further advantages result if longitudinally moveable and pivotable sinkers are disposed between the needles and also if needle cams are provided with a sinker control curve for moving the sinkers, the sinker control curves being designed such that the sinkers are expelled during withdrawal of the needles and the sinker control curves, at least in the latch closure region of the needles, preferably however in the entire expulsion region of the sinkers, have an expulsion angle ≤20°. In this configuration of the machine, the route required to achieve the necessary loop-forming depth is distributed to the needles and the sinkers so that the needles need perform a lesser expulsion and withdrawal movement than with machines without the use of this relative technology. As a result, the needle control curves of the needle cams can have a particularly flat design at least in the withdrawal region. Also the sinker control curves can have a flat course and have an expulsion angle of preferably ≤15°.

Furthermore, the needle control curves, in a portion of the withdrawal region of the needles which extends expediently at least over the latch closure region, can have a straight course. In this region of the needle control curve, the needles experience no changes in direction and no acceleration or braking so that, during the latch closure, uniform force influences are effected on the needle. The latch is loaded only with a small impetus, which implies less wear for the latch bearing, the latch spoon and the hook tip. Furthermore, these favourable conditions for the closure movement of the latch occur both for large-loop and for small-loop stitches. The theoretical time which is provided for the latch closure is significantly increased in comparison with known needle control curves.

Furthermore, it is advantageous if at least the needle control curve has a constant bend-free course. The needle control curve then changes from the expulsion region in rounded form into the withdrawal region. This is the most effective possibility for reducing the wear on the needle feet. In the case of known needle control curves, frequently bends are provided in the course, which lead to abrupt changes in direction which stress the needle feet and to changes in speed of the needles. In a further advantageous embodiment, the expulsion region for the needles is situated in the first third of the needle control curve. This means that the needle expulsion is effected very rapidly whilst a sufficiently large curve portion is available for the needle withdrawal in order to be able to design this to be flat. The expulsion angle of the needle control curve can be preferably ≥50°.

The machine according to the invention can be configured in particular as a circular knitting machine which has a speed factor >2,000 and/or a system density >3.2. This high system density and high speed are made possible by the needle-protecting needle control curves. Speed factors of 2,500 and system densities of 4.0 are entirely achievable. With such machines, significantly more material per minute can be produced than with known machines.

The invention relates in addition to needle cams for knitting or hosiery machines according to the invention, which have a needle control curve which, at least in the latch closure region of the needles, preferably in the entire withdrawal region for the needles, has a withdrawal angle ≤35°.

The needle control curve in the first third can thereby have a needle expulsion region with an expulsion angle ≥50°. Furthermore, the needle control curve can have a constant, bend-free course everywhere.

Preferred embodiments of needle cams of a circular knitting machine according to the invention are describe subsequently in more detail with reference to the drawings.

Figure 2:
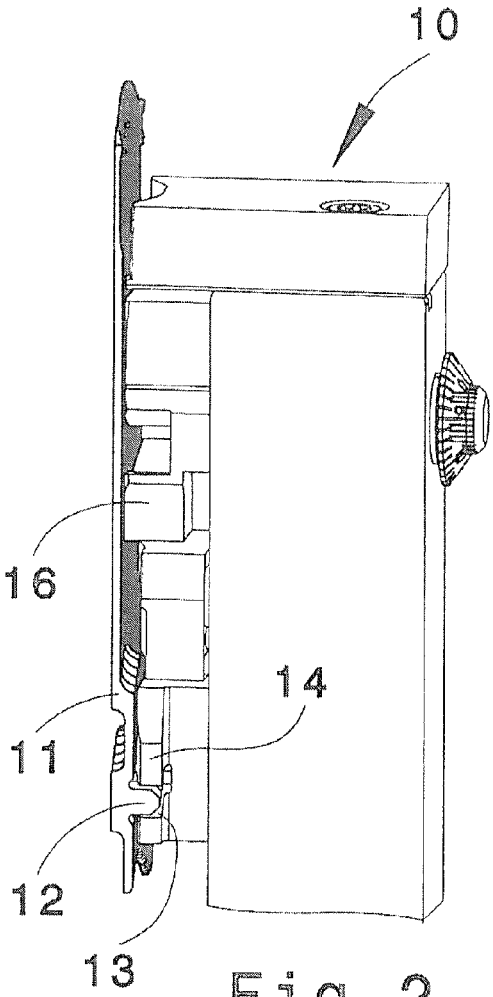
Figure 3:
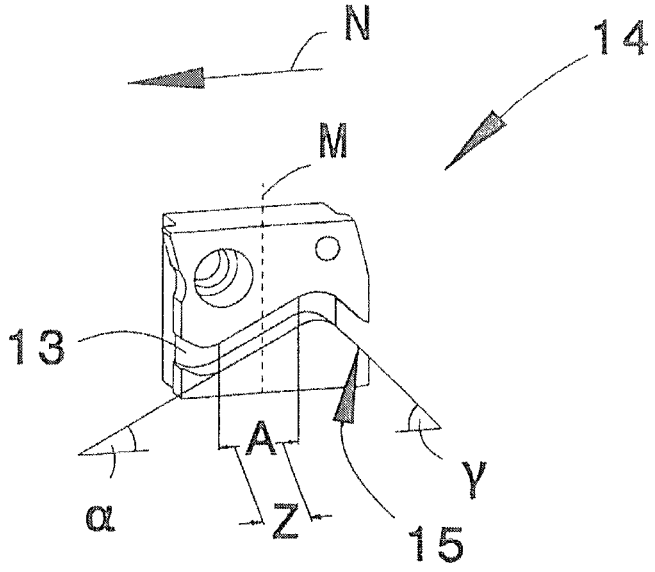
Figure 4:
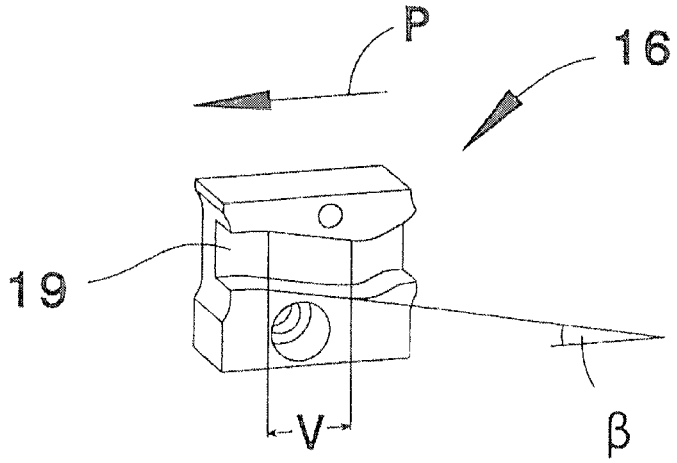
Figure 5:
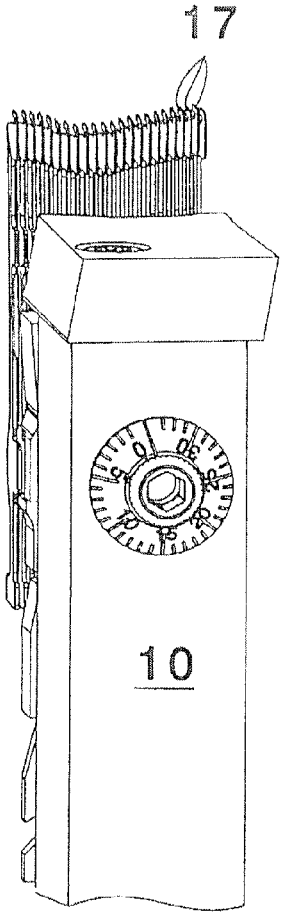
Figure 6:
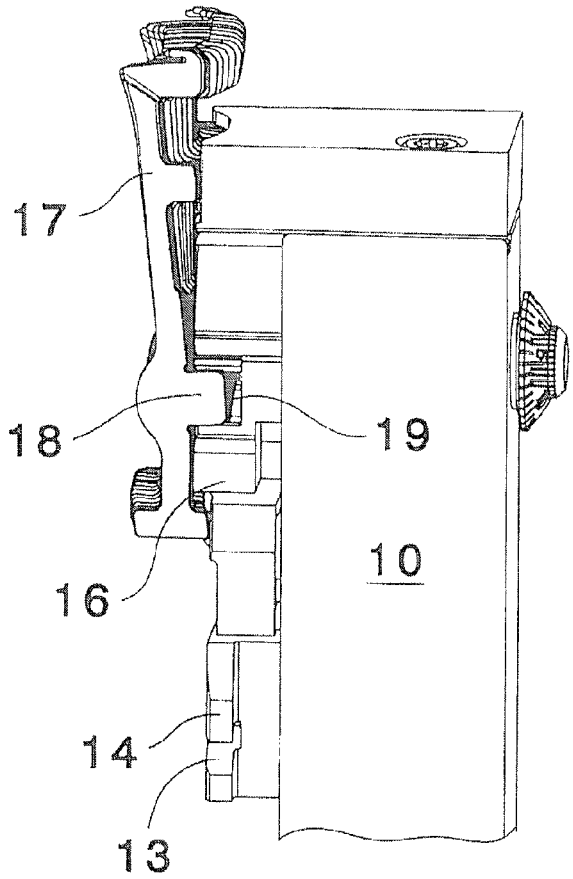
Figure 7:
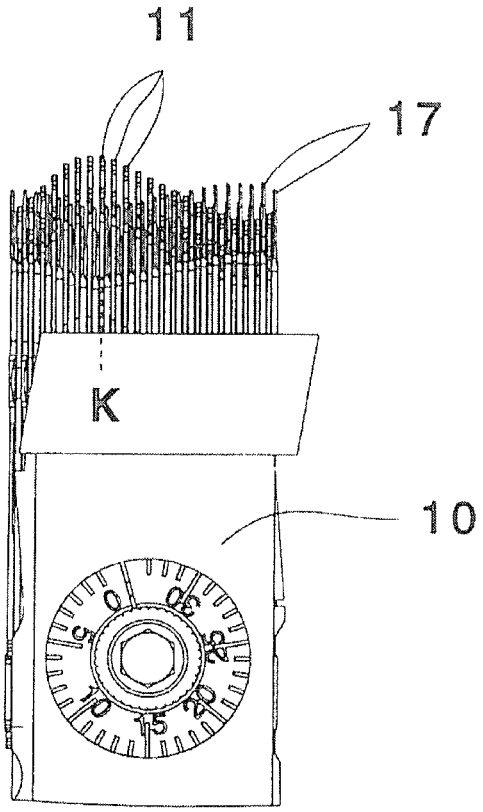

There are shown in detail:

FIG. 1 a perspective view of a cylinder cam segment of a circular knitting machine with needles guided through the segment;

FIG. 2 a side view on the cylinder cam segment of FIG. 1;

FIG. 3 a plan view on a needle cam of the cylinder cam segment of FIG. 1 with a needle control curve;

FIG. 4 a perspective view of a needle cam with a sinker control curve of the cylinder cam segment of FIG. 1;

FIG. 5 a perspective view of the cylinder cam segment of FIG. 1 with sinkers guided in the segment;

FIG. 6 a side view on the segment of FIG. 5;

FIG. 7 a view from outside on the cylinder cam segment of FIG. 1 with needles and sinkers guided in the segment.

FIG. 1 shows a cylinder cam segment 10 and needles 11 which are in engagement with the latter and are configured as latch needles.

It can be detected from the side view of the cylinder cam segment 10 in FIG. 2 that the knitting needles 11 which are disposed parallel to each other in grooves of a needle cylinder, not illustrated here in more detail, have a needle foot 12 which is guided in a needle control curve 13 of a needle cam 14 for controlling the needle movement.

Because of the shape of the needle control curve which can be detected in the detailed view of the needle cam 14 in FIG. 3, the needles 11 perform the expulsion and withdrawal movements evident from FIG. 1. The cylinder cam, not shown here in more detail, has a large number of abutting cylinder cam segments 10 of the same type of construction so that all the needles of the needle cylinder can be impinged upon by the needle cams 14 of the segments 10 in the same manner. In the embodiment shown here, the cylinder cam segments 10 are disposed radially outside the needle cylinder of the circular knitting machine and are stationary, whilst the needle cylinder is actuated to rotate.

The needle cams 14 shown in a detailed view in FIG. 3 are passed through by the needles 11 with their needle feet 12 in the direction of the arrow N. The needle control curve 13 has firstly a steeply rising portion 15 with an expulsion angle $\gamma \geq 50°$ by means of which the needles 11 are expelled. This portion in a rounded shape changes into a portion A of the withdrawal region which extends in a straight line and extends at an angle $\alpha$ to the horizontal, this withdrawal angle $\alpha$ preferably being less than 30° and not being exceeded at any point in the withdrawal region. The flat withdrawal region and also the shape of the control curve 13 which is configured everywhere to be bend-free and rounded protect both the needle feet 12 and the latches of the needles 11 which are closed whilst passing through portion A in a latch closure region Z by the needle feet 12.

Above the needle cams 14, needle cams 16 are disposed on the cylinder earn segments 10 in order to move sinkers 17 which are evident in FIGS. 5 and 6. As in particular the side view of FIG. 6 shows, the sinkers 17 are provided with sinker feet 18 which are guided in a sinker control curve 19 of the needle cam 16. With the help of the sinker control curve 19 which is evident in detail from the individual view of the needle cam 16 in FIG. 4, the sinkers 17 likewise perform withdrawal and expulsion movements. As an overall view of the curves 13 and 19 in FIGS. 3 and 4 shows, the movements of the sinkers 17 are thereby opposite over wide regions to those of the needles 11. This means that the sinker control curve 19 firstly falls and then changes into an expulsion portion V which extends in a straight line and includes an angle $\beta$ to the horizontal which is preferably ≤20°. As a result of the course of the sinker control curve 19 which is in total relatively flat and provided with few changes in direction, an extremely protecting movement of the sinkers 17 is also effected.

As FIG. 6 shows clearly, the sinkers not only perform a movement in the longitudinal direction but also a pivoting movement which is triggered by needle cams, not shown here in more detail.

In FIG. 7, a front view of the cylinder cam segment 10 during impingement of needles 11 and sinkers 17 is shown. It becomes clear from this illustration that a sinker 17 is disposed respectively between two needles 11. Also the essentially opposite movement of the sinkers 17 to the needles 11 can be detected readily from this illustration. Whilst the needles 11 are expelled, the sinkers 17 remain firstly in an almost unchanged height position and are then withdrawn to their lowest position, whilst the needles 11, at this point K, reach their maximum expulsion position. The spacing of the height position of the needle at the lowest point and of the sinker at the highest point determines the loop-forming depth and hence the loop size. After reaching the point K by the needles 11 which is situated in the first third of the cylinder cam segment 10, the withdrawal movement of the needles 11 begins, during which the latches of the needles 11 are closed by the loops hanging on the needles. During this closure movement, the needles 11 perform a uniform movement without a change in direction and without acceleration or braking. It is hence ensured that the closure process of the latches of the needles can be effected in a protecting manner, which is assisted in addition by the straight course of the needle control curve in the latch closure region Z.

It goes without saying that also the cylinder cam could be designed to rotate and the needle cylinder to be stationary. What is crucial for the loop-forming process is a relative movement between the needle cams 14, 16 and the needles 11 and the sinkers 17.

The invention claimed is:

1. A circular knitting machine, comprising:

a rotatably driven needle cylinder;

latch needles (11) which are mounted to be longitudinally moveable; and a plurality of needle cams (14) with a needle control curve (13) in a shape of a circular segment for moving the needles (11);

wherein in the needle control curves (13), at least in a latch closure region (Z) of a withdrawal region of the needles (11), have a withdrawal angle ($\alpha$)≤35°; and wherein the circular knitting machine has a system density >3.2.

2. The circular knitting machine according to claim 1, wherein the needle control curves (13), in the entire withdrawal region of the needles (11), have a withdrawal angle ($\alpha$)≤35°.

3. The circular knitting machine according to claim 1, wherein the withdrawal angle ($\alpha$) of the needle control curves (13) is ≤30°.

4. The circular knitting machine according to claim 1, wherein longitudinally moveable and pivotable sinkers (17) are disposed between the needles (11), needle cams (16) are provided with a sinker control curve (19) for moving the sinkers (17), the sinker control curves (19) designed such that the sinkers (17) are expelled during withdrawal of the needles (11) and the sinker control curves (19), at least in a latch closure region (Z) of the needles (11), have an expulsion angle ($\beta$)≤20°.

5. The circular knitting machine according to claim 3, wherein the sinker control curves (19), in an entire expulsion region of the sinkers (17), have an expulsion angle ($\beta$)≤20°.

6. The circular knitting machine according to claim 3, wherein the sinker control curves (19) have an expulsion angle ($\beta$)≤15°.

7. The circular knitting machine according to claim 1, wherein the needle control curves (13), in the withdrawal region of the needles (11), have a portion (A) with a straight course which extends at least over the latch closure region (Z).

8. The circular knitting machine according to claim 1, wherein the needle control curves (13) have a bend-free, constant course.

9. The circular knitting machine according to claim 1, wherein the needle control curves (13) have an expulsion region (15) which is in the first third of the needle control curves (13).

10. The circular knitting machine according to claim 1, wherein the needle control curves (13) have an expulsion angle $\gamma$≥50°.

11. The circular knitting machine according to claim 1, having it a speed factor >2,000.

12. A needle cam for a circular knitting machine according to claim 1, having a needle control curve (13) which, at least in the latch closure region (Z) of the needles, has a withdrawal angle ($\alpha$)≤35°.

13. The needle cam according to claim 12, wherein the needle control curve (13) in a first third has a needle expulsion region with an expulsion angle $\gamma$≥50°.

14. The needle cam according to claim 12, wherein an entirety of the needle control curve (13) has a constant, bend-free course.

* * * * *